US005827423A

United States Patent [19]

Lee

[11] Patent Number: 5,827,423

[45] Date of Patent: Oct. 27, 1998

[54] FILTERING DEVICE FOR A WASHING MACHINE

[75] Inventor: Am-Kyu Lee, Kwangiu, Rep. of Korea

[73] Assignee: Daewoo Electronics Co., Ltd., Rep. of Korea

[21] Appl. No.: 865,938

[22] Filed: May 30, 1997

[30] Foreign Application Priority Data

May 31, 1996 [KR] Rep. of Korea ..... 96-14515

[51] Int. Cl.[6] ..... B01D 29/66; B01D 29/94; B01D 35/22; D06F 39/10

[52] U.S. Cl. ..... 210/167; 210/237; 210/238; 210/409; 210/416.1; 210/456; 68/18 F

[58] Field of Search ..... 210/167, 237, 210/238, 416.1, 409, 456; 68/12.13, 18 F

[56] References Cited

U.S. PATENT DOCUMENTS

| | | |
|---|---|---|
| 1,822,006 | 9/1931 | Bull . |
| 3,332,259 | 7/1967 | Zylstra . |
| 3,335,864 | 8/1967 | Miller . |
| 3,543,542 | 12/1970 | Bochan . |
| 3,727,435 | 4/1973 | Menk . |
| 3,774,418 | 11/1973 | Ohmann . |
| 4,204,967 | 5/1980 | Bannister . |
| 4,833,900 | 5/1989 | Babuin . |
| 5,024,771 | 6/1991 | Chiarito . |
| 5,545,318 | 8/1996 | Richmond . |

FOREIGN PATENT DOCUMENTS

| | | |
|---|---|---|
| 1191781 | 4/1965 | Germany . |
| 1585818 | 11/1979 | Germany . |
| 2 033 528 | 5/1980 | United Kingdom . |

*Primary Examiner*—Thomas M. Lithgow
*Attorney, Agent, or Firm*—Cushman Darby & Cushman Intellectual Property Group of Pillsbury Madison & Sutro, LLP

[57] ABSTRACT

A filtering device for use in a washing machine is disclosed. The filtering device has a filtering web disposed so that a planar direction thereof is equal with a flowing direction of the washing water in the pipe in which washing water circulates, and many ribs disposed on the filtering web to form a lattice. Longitudinal directions of the ribs have a predetermined angle against the flowing direction of the washing water. The washing water flowing in the pipe during a draining operation is guided toward the edge areas of the filtering web, so it is distributed to be in uniform contact with the filtering web. The dirt having been adhered to the filtering web during the washing operation is efficiently removed by the washing water guided by the ribs during the draining operation.

3 Claims, 3 Drawing Sheets

FILTERING DEVICE FOR A WASHING MACHINE

BACKGROUND OF THE INVENTION

1. Field of the Invention

The present invention relates to a filtering device for a washing machine, and more particularly to a filtering device installed in a pipe in which washing water circulates during a washing operation in order to filter dirt in washing water.

2. Prior Art

Generally, a washing machine which accommodates laundry and performs washing and dehydrating operations has, as shown in FIG. 1, an outer-tub 1 installed in an outer-casing 10, a washing tub 2 installed in the outer-tub 1 for accommodating laundry and water for washing, a pulsator 3 mounted on the bottom of the washing tub 2 for rotating the washing water in the washing tub 2, a driving motor 4 disposed under the outer-tub 1 for driving the pulsator 3, and a gear assembly 5 for transmitting the power of the driving motor 4 selectively to the pulsator 3 and the washing tub 2.

During the washing operation, the power of the driving motor 4 is transmitted to the pulsator 3 through the gear assembly 5 in order to rotate the pulsator 3, by which vortical water flow is generated in the washing tub 2. The washing operation of the laundry accommodated in the washing tub 2 is performed by the vortical water flow generated by the pulsator 3. In the dehydrating operation, the power of the driving motor 4 is transmitted to both the washing tub 2 and the pulsator 3, so the washing tub 2 is rotated together with the pulsator 3 at a high speed. The dehydrating operation is performed by centrifugal force generated in that situation.

A drain pipe 11 is installed under the outer-tub 1. The drain pipe 11 is connected with a drain hose 12 which is outside the outer-casing 10. Between the drain pipe 11 and the drain hose 12, a bellows 16 is installed. The bellows 16 controls the connection between the drain pipe 11 and the drain hose 12 to be opened or closed. At an end part of the drain pipe 11, a circulating pipe 13 is bifurcated from the drain pipe 11. At the position that the circulating pipe 13 bifurcates from the drain pipe 13, a filtering device 20 is disposed. The circulating pipe 13 connects the drain pipe 11 with the washing tub 2. A pump 15 is installed in the middle area of the circulating pipe 13.

During the washing operation, the bellows 16 operates to close the drain hose 12, and the pump 15 operates to suck the washing water in the drain pipe 11. Thus, the washing water in the outer-tub 1 is circulated into the washing tub 2 through the drain pipe 11, the filtering device 20, and the circulating pipe 13, and at that time, the dirt in the washing water is filtered by the filtering device 20. In the draining operation and the dehydrating operation, the bellows 16 opens the drain hose 12, and then the washing water in the drain pipe 11 is discharged outside through the drain hose 12.

FIG. 2 is a perspective view of the filtering device 20 disposed between the drain pipe 11 and the circulating pipe 13. The filtering device 20 comprises a filtering web 22 which is formed with holes 23 for filtering dirt, and a knob member 21 attached to the filtering web 22. The knob member 21 provides the knob part for assembling and disassembling the filtering device 20 with the washing machine. The dirt in the washing water circulating in the drain pipe 11 and the circulating pipe 13 is filtered by the filtering web 22. Accordingly, the dirt in the washing tub 2 is reduced, so the washing operation is efficiently performed. In the draining operation, the washing water is discharged outside through the drain pipe 11 and the drain hose 12.

However, in such a conventional filtering device 20 used in washing machine, there is a problem that the user should disassemble the filtering device 20 from the washing machine in order to remove the dirt adhered to the filtering web 22, and thereafter reassemble the filtering device 20 to the washing machine after removing the dirt by hand. Although a possible effect may be that the dirt adhered to the filtering web 22 is removed a little by the washing water flowing in the drain pipe 11 and the drain hose 12 during the drain operation, the dirt cannot be removed effectively since the flowing direction of the washing water is constant. Therefore, the user should disassemble the filtering device 20 frequently to remove the dirt.

SUMMARY OF THE INVENTION

The present invention has been proposed to overcome the above described problems in the prior art, and accordingly it is an object of the present invention to provide a filtering device for use in a washing machine in which the dirt can be removed by washing water flowing during the drain operation, and accordingly the frequent manual cleaning is not needed.

To achieve the above object, the present invention provides a filtering device for use in a washing machine, said filtering device being installed between a drain pipe for draining washing water in a washing tub during a draining operation and a circulating pipe being bifurcated from said draining pipe for circulating the washing water flowing in said drain pipe into said washing tub during a washing operation, said filtering device for filtering dirt from the washing water circulating into said tub through said drain pipe and said circulating pipe, said filtering device comprising: a filtering web installed at a bifurcating entrance of said circulating pipe, said filtering web being disposed so that a planar direction thereof is equal to a flowing direction of the washing water in said drain pipe; and a plurality of ribs being disposed on said filtering web so as to form a lattice, said ribs being disposed so that longitudinal directions thereof have a predetermined angle against the flowing direction of the washing water, whereby the washing water flowing in said drain pipe is guided toward an entire area of said filtering device to be in uniform contact with said filtering web.

BRIEF DESCRIPTION OF THE DRAWINGS

The present invention will be better understood and its various objects and advantages will be more fully appreciated from the following description taken in conjunction with the accompanying drawings, in which.

DETAILED DESCRIPTION OF THE PREFERRED EMBODIMENT

Figure 1:
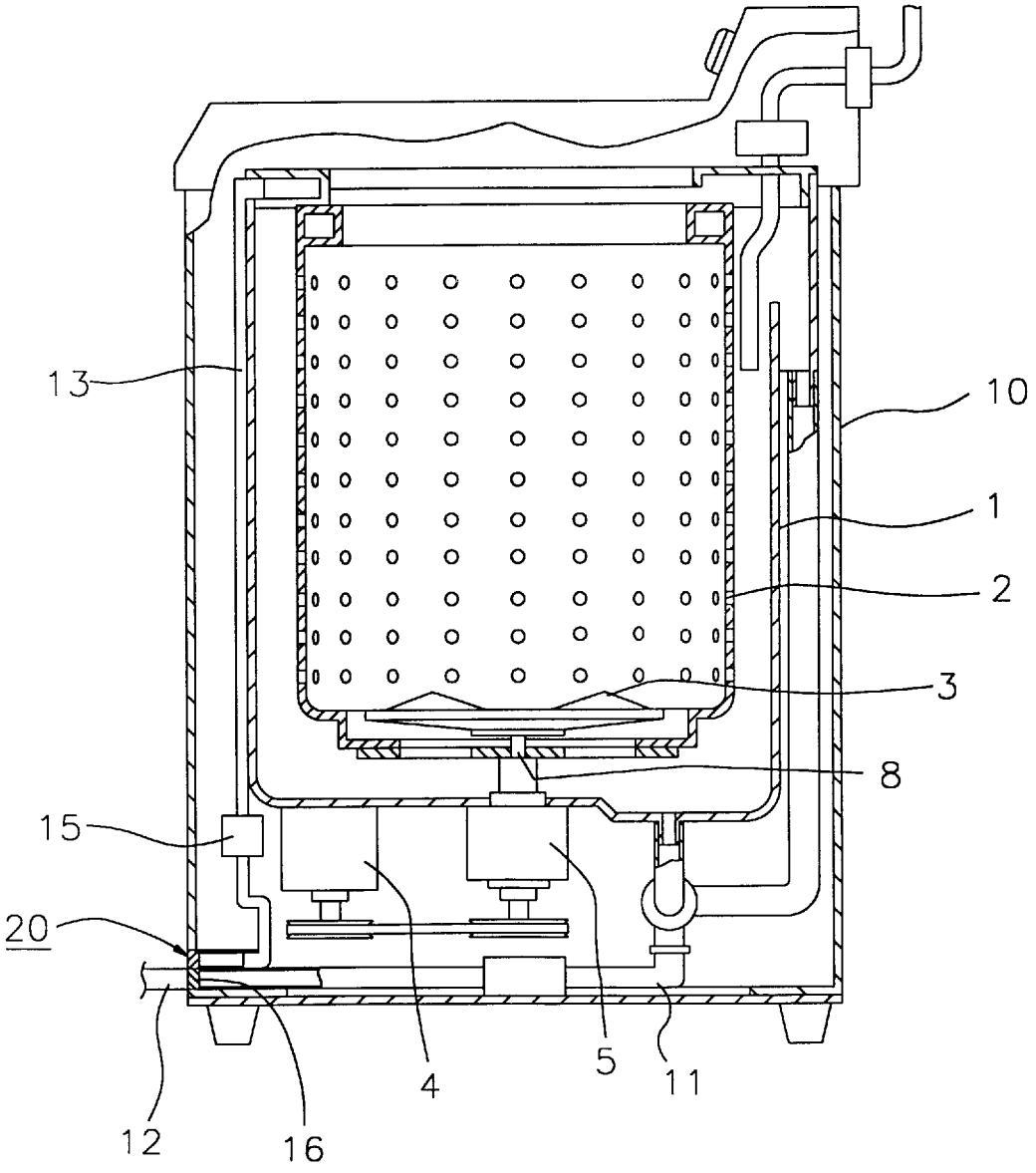
FIG. 1 PRIOR ART
FIG. 1 is a side sectional view of a general washing machine.
Figure 2:
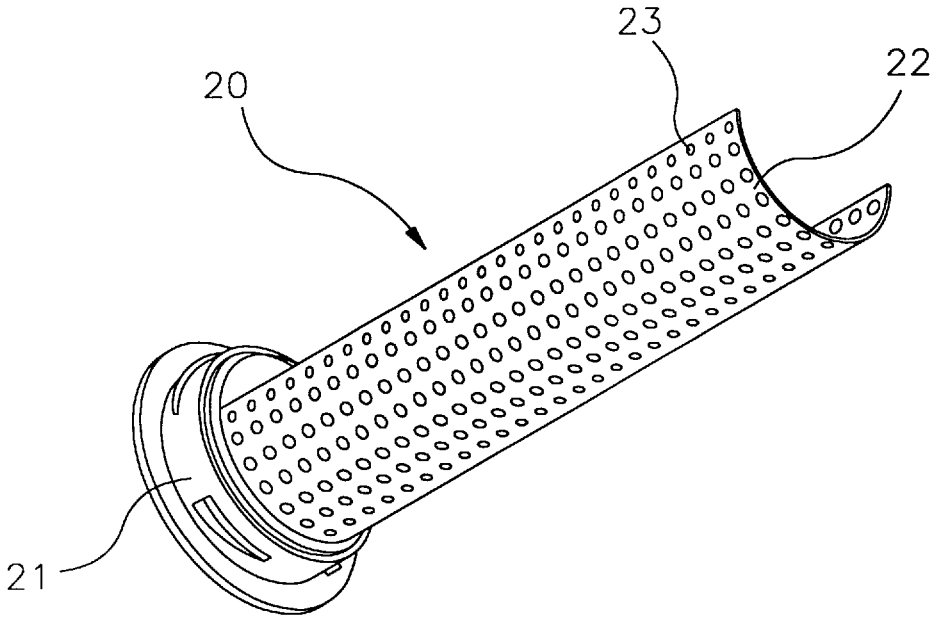
FIG.2 PRIOR ART
FIG. 2 is a perspective view of a conventional filtering device.

Hereinafter, the present invention will be described in detail with reference to the drawings. Also, the present invention will be described with reference to the conventional washing machine shown in FIG. 1, and the same parts illustrated in FIG. 1 will be referred to by the same reference numerals.

Figure 3:
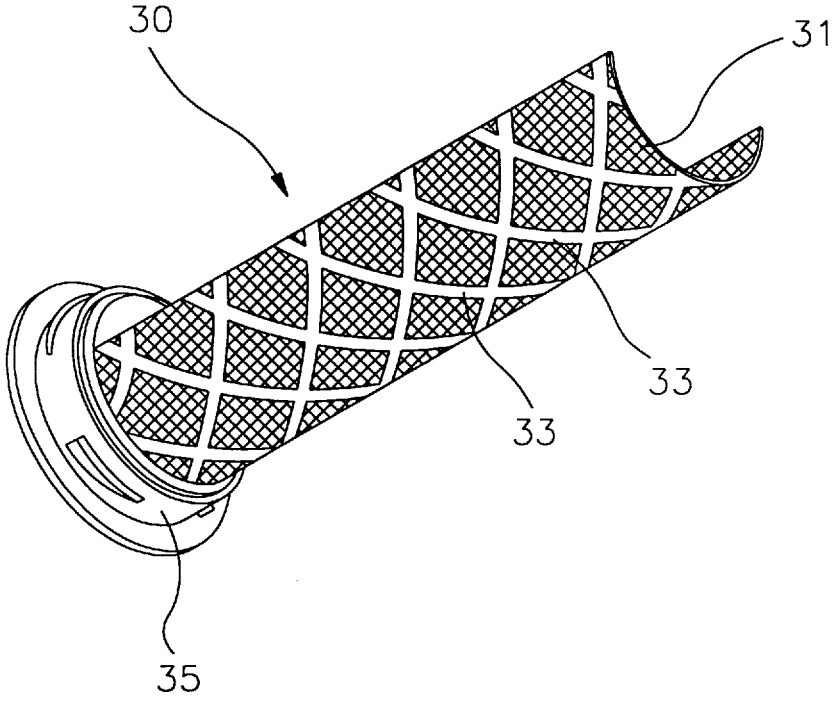
FIG. 3 is a perspective view of a filtering device according to the present invention.

FIG. 3 is a perspective view of a filtering device according to the present invention. The filtering device 30 is, as in the washing machine shown in FIG. 1, disposed at the bifurcated position of the circulating pipe 13 from the drain pipe 11. The filtering device 30 comprises a filtering web 31 for filtering dirt, a knob member 35 attached to the filtering web 31, and a plurality of ribs 33 disposed on the filtering web 31. The filtering web 31 is installed at a bifurcating entrance of the circulating pipe 13, and is disposed so that the planar direction thereof is equal with the flowing direction of the washing water in the drain pipe 11. The dirt in the washing water circulating in the drain pipe 11 and the circulating pipe 13 is filtered by the filtering web 31. Thus the amount of dirt in the washing tub 2 is reduced so the washing efficiency is enhanced. The knob member 35 provides the knob part for installing the filtering device 30 into the washing machine.

The ribs 33 are formed together with the filtering web 31, and are disposed to form a lattice shape. The ribs 33 are disposed so that longitudinal directions thereof have a predetermined angle against the flowing direction of the washing water in the drain pipe 11. Therefore, when the washing water flowing in the drain pipe 11 is in contact with the ribs 33, it is guided toward the edge areas of the filtering web 31 by the ribs 33. Thus the washing water is distributed to the entire area of the filtering web 31 so as to be in uniform contact with the filtering web 31.

In the washing operation, the bellows 16 operates to close the drain hose 12, and the pump 15 operates to suck the washing water in the drain pipe 11. Thus, the washing water in the outer-tub 1 is circulated into the washing tub 2 through the drain pipe 11, the filtering device 30, and the circulating pipe 13, and during that time, the dirt in the washing water is filtered by the filtering web 31. In the draining operation and the dehydrating operation, the drain hose 12 is opened by the bellows 16, then the washing water in the drain pipe 11 is discharged outside through the drain hose 12. During that time, the washing water flowing in the drain pipe 12 is guided to the edge areas of the filtering web 31 by the ribs 33 which are disposed to be tilted against the flowing direction of the washing water. Therefore, the washing water becomes complex since the part of the washing water flows along the longitudinal direction of the ribs 33, and the washing water becomes in uniform contact with the entire area of the filtering web 31 Then the washing water removes the dirt adhered to the filtering web. Since the dirt adhered to the filtering web 31 is removed by the washing water, the amount of the dirt adhered to the filtering web 31 is reduced, and the user doesn't have to disassemble the filtering device 30 from the washing machine frequently in order to clean it.

As described above, according to the present invention, the washing water guided by the ribs 33 during the draining operation efficiently removes the dirt filtered by the filtering web 31, and the filtering device need not be cleaned frequently.

Although the present invention has been described and illustrated in detail, it is clearly understood that the same is by way of illustration and example only and is not to be taken by way of limitation, wherein the spirit and scope of the present invention is limited only by the terms of the appended claims.

What is claimed is:

1. A filtering device for a washing machine, said filtering device being installed between a drain pipe for draining washing water in a washing tub during a draining operation and a circulating pipe being bifurcated from said draining pipe for circulating the washing water flowing in said drain pipe into said washing tub during a washing operation, in order to filter dirt from the washing water circulating into said tub through said drain pipe and said circulating pipe, said filtering device comprising:

a filtering web having a plurality of holes therein and installed at a bifurcating entrance of said circulating pipe, said filtering web being disposed so that a planar direction thereof is equal to a flowing direction of the washing water in said drain pipe; and a plurality of ribs being disposed on said filtering web so as to form a lattice, said ribs being disposed so that longitudinal directions thereof have a predetermined angle against the flowing direction of the washing water, whereby the washing water flowing in said drain pipe is guided toward an entire area of said filtering device to be in uniform contact with said filtering web.

2. The filtering device as claimed in claim 1, wherein said ribs are formed together with said filtering web.

3. The filtering device as claimed in claim 2, further comprising a knob member attached to said filtering web for providing a knob part when said filtering web is assembled and disassembled.

* * * * *